United States Patent [19]

Fava

[11] 4,015,378

[45] Apr. 5, 1977

[54] DEVICE FOR CLAMPING FLAT PANELS AGAINST METAL SECTION UPRIGHTS, PARTICULARLY FOR LINING DRYING CHAMBERS

[75] Inventor: Enrico Fava, Cento (Ferrara), Italy

[73] Assignee: Essiccatoi Fava S.p.A., Cento (Ferrara), Italy

[22] Filed: June 1, 1976

[21] Appl. No.: 691,873

[30] Foreign Application Priority Data

June 12, 1975 Italy ..... 24316/75

[52] U.S. Cl. ..... 52/127; 52/69; 52/476; 52/484; 52/486

[51] Int. Cl.[2] ..... E04B 2/82

[58] Field of Search ..... 52/69, 127, 486, 500, 52/455, 456, 457, 483, 484, 291, 476, 749

[56] References Cited

UNITED STATES PATENTS

| | | | |
|---|---|---|---|
| 1,841,204 | 1/1932 | Overholtz | 52/483 X |
| 2,053,438 | 9/1936 | Lunken et al. | 52/573 X |
| 2,095,037 | 10/1937 | Reintjes | 52/500 X |
| 2,363,917 | 11/1944 | Waterman et al. | 52/127 X |
| 2,795,015 | 6/1957 | Foley | 52/127 X |
| 2,821,274 | 1/1958 | Olsen | 52/502 X |
| 2,989,155 | 6/1961 | Ocker | 52/127 X |
| 3,341,992 | 9/1967 | Piper | 52/127 |
| 3,512,325 | 5/1970 | Nichols | 52/127 X |
| 3,608,266 | 9/1971 | Satkin et al. | 52/127 X |
| 3,636,669 | 1/1972 | Attkisson | 52/483 X |
| 3,670,469 | 6/1972 | Jones | 52/486 X |

FOREIGN PATENTS OR APPLICATIONS

| | | | |
|---|---|---|---|
| 1,294,818 | 4/1962 | France | 52/483 |
| 841,722 | 4/1952 | Germany | 52/483 |
| 438,975 | 9/1948 | Italy | 52/483 |

*Primary Examiner*—Price C. Faw, Jr.
*Assistant Examiner*—Leslie Braun
*Attorney, Agent, or Firm*—Diller, Brown, Ramik & Wight

[57] ABSTRACT

This invention relates to a device for clamping flat panels against metal section uprights, particularly for lining drying chambers, for example for food pasta. The device according to the invention comprises means for hooking or hinging the panels to the upper horizontal sections of the supporting structure, and butt straps which vertically cover the joints between two adjacent panels at the uprights, each butt strap being provided with spaced projecting wedge-shaped elements which cooperate with inclined plane intake pieces projecting from the upright. Means are also provided to exert a traction downwards on the butt straps so as to lock the wedge-shaped elements in the respective intake pieces, so that the panel edges are pushed perpendicularly to the support surfaces of the uprights.

3 Claims, 3 Drawing Figures

DEVICE FOR CLAMPING FLAT PANELS AGAINST METAL SECTION UPRIGHTS, PARTICULARLY FOR LINING DRYING CHAMBERS

This invention relates to a device for clamping flat panels against metal section uprights, particularly for lining drying chambers, for example for food pasta.

Drying chambers are normally lined with highly insulating panels, and in known constructions these panels are fixed to a support structure normally consisting of metal sections. It must obviously be ensured that the panels fixed to this structure are perfectly and uniformly sealed in order to prevent any outward escape of heat and to maintain very precise environmental conditions (temperature, humidity, etc.) in the chamber.

The lining walls of these drying chambers are generally of considerable height, because of which a large number of fixing elements are required for fixing the panels to the support structure. On the other hand, every part of the interior of the drying chamber in contact with the product to be dried must be accessible, not only for carrying out periodical cleaning but also to allow any checks and maintenance.

The dismantling of the individual lining panels of drying chambers is a very laborious and complicated operation in known constructions, as the individual fixing members have to be removed, after which the liberated panel is extracted, which is not easy to accomplish without the aid of suitable tools because of the considerable height of the panels. The reassembly of the panels must also be done with great care to ensure that a perfect uniform seal is again obtained.

The object of the present invention is therefore to provide a device which enables lining panels for drying chambers to be dismantled and reassembled rapidly, and which ensures that when the panel has been assembled it is perfectly and uniformly sealed against the sections of the support structure.

In attaining this object, the device according to the invention comprises means for hooking or hinging the individual panels to the upper horizontal sections of the supporting structure, and butt straps fastened upperly to the support structure and designed to vertically cover the joints between two adjacent panels at the structure uprights, each of said butt straps being provided on that face facing the respective upright with a series of projecting wedge-shaped elements spaced apart and arranged to co-operate with a like number of inclined plane intake pieces projecting from the upright, means being also provided at the lower end of each butt strap to exert a traction downwards thereon so as to lock the wedge-shaped elements in the respective inclined plane intake pieces and to consequently exert a pressure on the panel edges in a direction perpendicular to the support surfaces of the uprights of the supporting structure.

The means for pulling the butt straps downwards consist preferably of simple hook levers mounted at the lower ends of the butt straps and hookable to suitable hooks rigid with the uprights.

To the inner perimeter of each panel there is glued a suitable rubber or plastics gasket by which the panel rests on the front surfaces of two uprights and relative connecting cross members of the supporting structure.

The inclined plane intake pieces are fixed on the center line of the front surface of the uprights, and the wedge-shaped elements of the butt straps are located on the center line of the rear face of these latter, so that these elements and the respective intake pieces are coupled on the vertical joint gap between two adjacent panels.

With a single lower control device (hook lever) the compression of the butt joints on the edges of the panels and the compression of these latter on the support surfaces of the uprights by way of the inner gaskets are uniformly distributed independently of the height of the panels, because of the plurality of coupling points distributed over the height of the butt straps, so ensuring perfect and uniform sealing of the panels against the uprights.

To free the panels for removing or displacing them for inspection, checking, cleaning or the like, the hook levers need only be released downwards and the butt straps moved slightly upwards so as to disengage the wedge-shaped elements from the respective inclined plane intake pieces. The butt straps remain fastened upperly to the support structure, while the panels may be freely and individually removed or displaced.

The device according to the invention and the advantages obtained by it will be more evident from the description given hereinafter of one embodiment by way of example, illustrated in the accompanying drawings in which.

Figure 1:
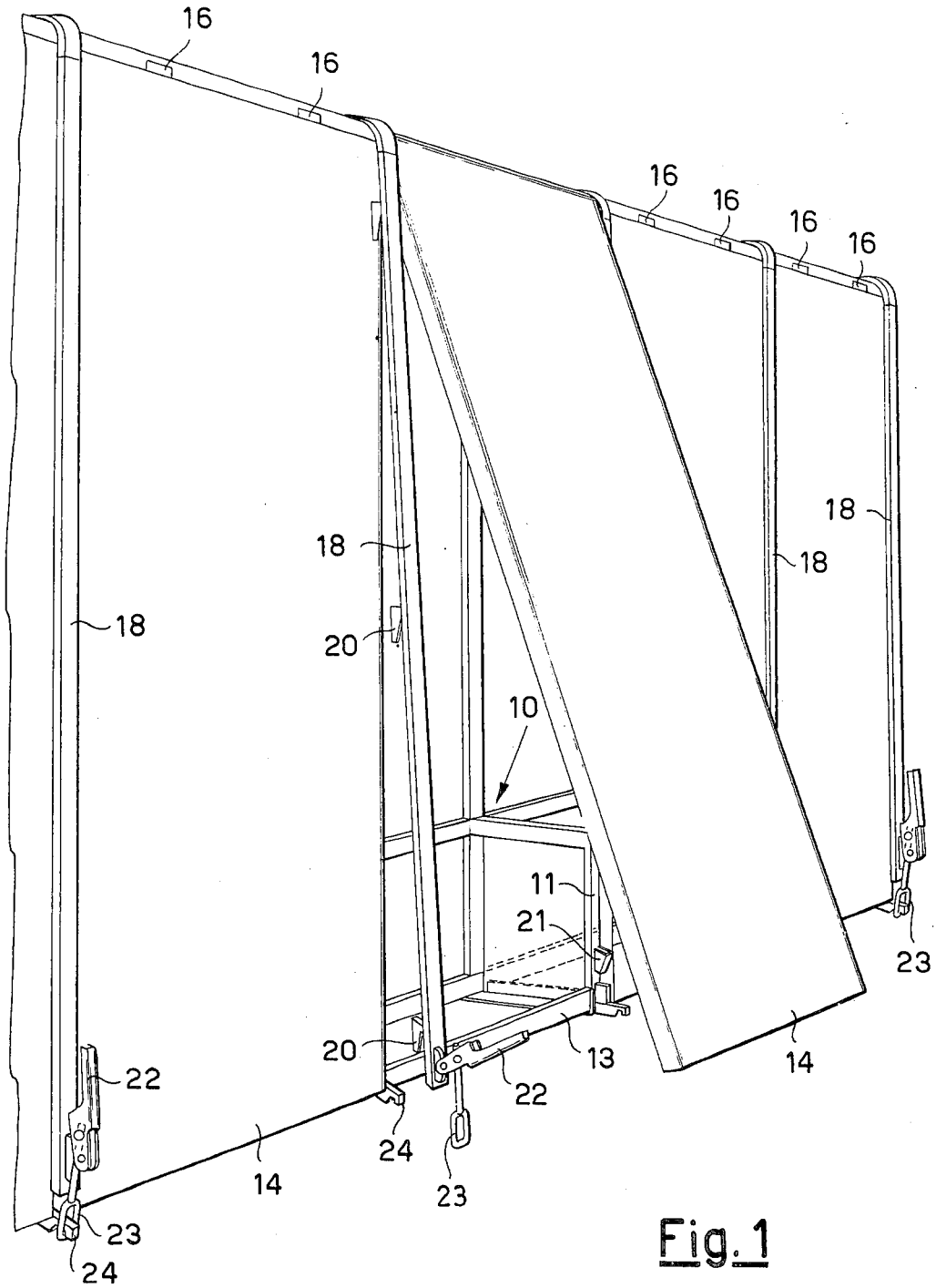
FIG. 1 is a diagrammatic perspective view from the outside of part of a wall constructed with individual panels clamped by the device according to the invention.

As the drawings clearly show, the structure, indicated overall by 10, for supporting the wall of, for example, a drying chamber for food pasta (not shown) comprises external uprights 10 consisting of metal sections connected at least at the top and bottom by cross members 12, 13 which also consist of metal sections. Each pair of uprights 11 with their relative connection cross members 12, 13 form an abutment frame on which is rested a lining panel 14 by way of a gasket 15 glued to the perimeter of the rear surface of the panel.

Each panel 14 upperly comprises hooks 16 by which the panel is freely hung on hooking elements 17 rigid with the upper cross members 12 of the supporting structure. In this manner, the panels 14 may be easily removed by slightly raising them.

Figure 2:
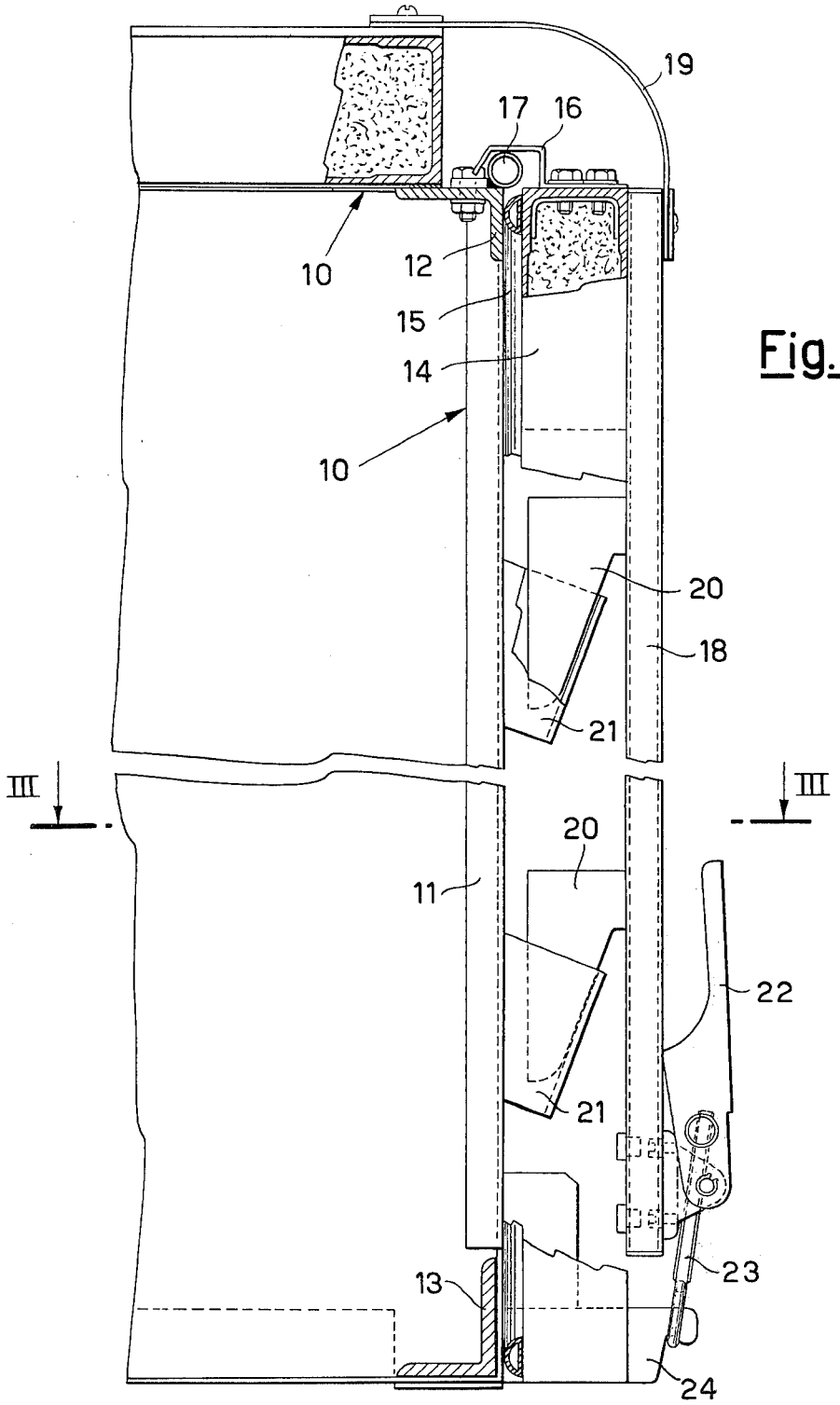
FIG. 2 is a vertical section on the joint between two adjacent panels.
Figure 3:
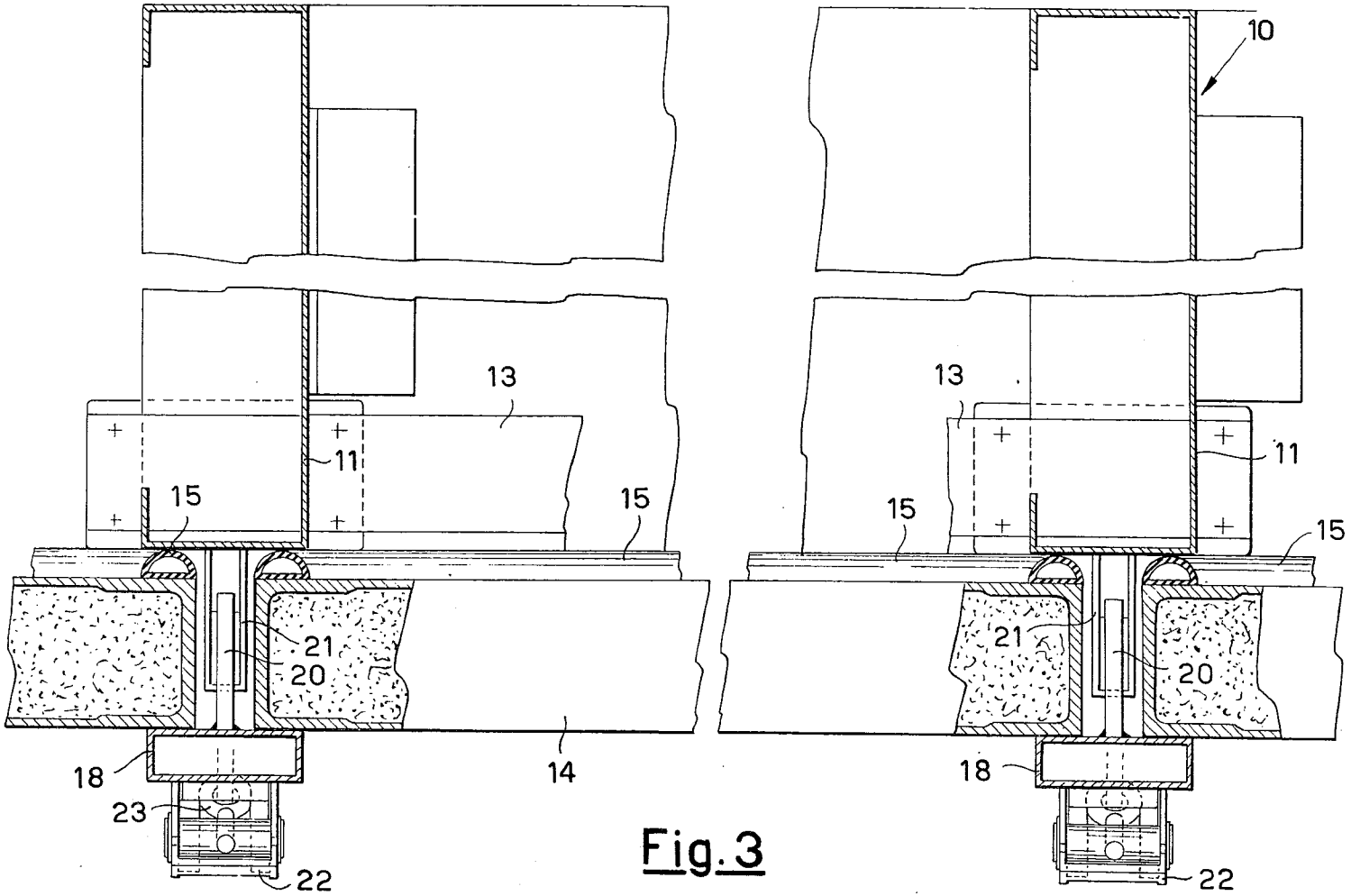
FIG. 3 is a horizontal section on the line II—II of FIG. 2.

Butt straps 18 fastened upperly by flexible support bands 19 to the top of the structure 10 are provided for clamping the panels 14 against the abutment frame. Each butt strap 18 is designed to cover the vertical joint gap between two adjacent panels on the outside of the wall and to clamp the edges of the relative panels against the front surface of the upright 11 by way of the inner gasket. To ensure uniform compression over its entire height, the butt strap 18 comprises a set of wedge-shaped projecting elements 20 uniformly spaced apart along the center line on its rear side, and arranged to engage with a similar number of inclined plane intake pieces 21 fitted to the center line of the front surface of the uprights 11 (as is clearly visible in FIGS. 2 and 3).

Each butt strap 18 comprises at its lower end a lever 22 to which an arm is hinged, terminating in an eyelet 23 which can be hooked to a hook 24 rigid with the upright 11. By locking the lever 22 in the position shown in FIG. 2, the relative butt strap 18 is pulled taut downwards with the wedge-shaped elements 20 engaged in the intake pieces 21, by which the butt strap is uniformly compressed on the edges of the two relative adjacent panels, and these are held uniformly pressed by way of their inner gaskets 15 against the front surface of the upright 11.

Because of the plurality of couplings between elements 20 and intake pieces 21 for each butt strap 18, the compression is distributed uniformly independently of the height of the panels, so ensuring a perfect seal.

It should be noted that this result is obtained with maximum simplicity, as the hook levers 22 are lowerly situated and no other operation has to be carried out. The individual panels may be freed equally simply and rapidly be releasing the levers 22 of the two butt straps 18 concerned with the panel to be freed, and slightly moving these butt straps upwards to disengage the wedge-shaped elements 20 from the relative intake pieces 21. The freed wall may then be removed by unhooking the hooks 16 from the elements 17, or may be simply displaced (as shown in FIG. 1) for the required inspection, cleaning or checking.

Instead of being hooked upperly to the supporting structure, the individual panels could be hinged thereto, in which case they could be moved into the inclined position shown in FIG. 1.

The main advantage of the device according to the invention is the ease and rapidity of clamping the panels in a perfectly sealed manner independently of their height. The number of coupling points between elements 20 and intake pieces 21 provided for each butt strap obviously depends on the height of this latter.

What we claim is:

1. Device for clamping flat panels against a supporting structure comprising spaced metal section uprights and upper and lower horizontal cross members, particularly for lining drying chambers, comprising means for hooking or hinging the individual panels to the upper horizontal cross members of the supporting structure, and butt straps fastened upperly to the structure and designed to vertically cover the joints between two adjacent panels at the structure uprights, each of said butt straps being provided on that face facing the respective upright with a series of projecting wedge-shaped elements spaced apart and arranged to co-operate with a like number of inclined plane intake pieces projecting from the upright, means being also provided at the lower end of each butt strap to exert a traction downwards thereon so as to lock the wedge-shaped elements in the respective inclined plane intake pieces and to exert a pressure on the panel edges in a direction perpendicular to the support surfaces of the uprights.

2. Device as claimed in claim 1, wherein a hook lever is fitted to the lower end of each butt strap for hooking to a projecting hook rigid with the respective upright of the supporting structure.

3. Device as claimed in claim 1, wherein each panel comprises on its inner perimeter a gasket for its support on the front surfaces of two uprights and two relative connecting cross members of the supporting structure.

* * * * *